US008544979B2

(12) United States Patent
Hoki

(10) Patent No.: US 8,544,979 B2
(45) Date of Patent: Oct. 1, 2013

(54) EJECTION INSPECTING DEVICE, PRINTER AND EJECTION INSPECTING METHOD

(75) Inventor: Saori Hoki, Shizuoka (JP)

(73) Assignee: Seiko Epson Corporation, Tokyo (JP)

( * ) Notice: Subject to any disclaimer, the term of this patent is extended or adjusted under 35 U.S.C. 154(b) by 611 days.

(21) Appl. No.: 12/229,088

(22) Filed: Aug. 20, 2008

(65) Prior Publication Data

US 2009/0225125 A1 Sep. 10, 2009

(30) Foreign Application Priority Data

Aug. 20, 2007 (JP) ..... 2007-213424

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 4,121,223 | A * | 10/1978 | Omori et al. | 347/81 |
| 6,259,069 | B1 * | 7/2001 | Schotten et al. | 219/447.1 |
| 2004/0206179 | A1 | 10/2004 | Kamiyama | |
| 2007/0134969 | A1 | 6/2007 | Endo et al. | |

FOREIGN PATENT DOCUMENTS

| | | | | |
|---|---|---|---|---|
| JP | 2000-158670 | * | 6/2000 | 347/19 |
| JP | 2004-306475 | | 11/2004 | |
| JP | 2004-306475 | A | 11/2004 | |
| JP | 2005-262867 | | 9/2005 | |
| JP | 2006-76082 | | 3/2006 | |

OTHER PUBLICATIONS

European Search Report Dated Dec. 19, 2008.

* cited by examiner

*Primary Examiner* — Julian Huffman
(74) *Attorney, Agent, or Firm* — Nutter McClennen & Fish LLP; John J. Penny, V.

(57) ABSTRACT

An ejection inspecting device is operable to inspect an ejection state of a fluid ejection device operable to eject a fluid. The ejection inspecting device includes: at least one pair of electrodes, disposed so that the fluid can pass; an oscillation executing unit, connected to the electrodes, and operable to electrically oscillates; an oscillation detecting unit, operable to detect an oscillation state oscillated by the oscillation executing unit by counting the number of oscillations during a predetermined period; and a control unit, operable to detect whether the fluid has been ejected from the fluid ejection device based on the number of oscillations detected during the predetermined period during which the fluid has not been ejected, and based on the number of oscillations detected during the predetermined period during which the fluid ejected therefrom has passed near the electrodes.

12 Claims, 5 Drawing Sheets

EJECTION INSPECTING DEVICE, PRINTER AND EJECTION INSPECTING METHOD

BACKGROUND

1. Technical Field

This invention relates to an ejection inspecting device, a printer, and an ejection inspecting method.

2. Related Art

There is an apparatus including a pair of electrodes disposed to face each other so that ink ejected from a print head passes between the electrodes, a coil connected to an end of the electrodes, and an oscillator connected to the coil and to an opposite end of the electrodes as an ejection inspecting device (see JP-A-2000-158670, for example). The apparatus disclosed in JP-A-2000-158670 has a resonance circuit including the electrodes, the coil, and the oscillator. The apparatus adjusts the oscillation frequency of the oscillator so that the resonance circuit reaches a resonant state when no droplet of ink is present between the electrodes, and detects adeviation in the resonant state of the resonance circuit when droplets of ink that have not been electrically-charged pass between the electrodes. Thus, an inspection is made of whether ink droplets have been ejected from the print head.

However, in the apparatus disclosed in JP-A-2000-158670, although it is possible to inspect whether droplets of ink have been ejected without charging the ink with electricity, for example, by applying a voltage onto the electrodes, there has been a case in which, for example, because the ink droplet is small in size, a deviation in the resonant state of the resonance circuit is small even if ink droplets pass between the electrodes, and hence an inspection cannot be highly accurately made of whether ink droplets have been ejected.

SUMMARY

An advantage of some aspects of the invention is to provide an ejection inspecting device, a printer, and an ejection inspecting method each of which is capable of inspecting the ejection state of a fluid with greater ease and with higher accuracy when the ejection state of the fluid is inspected according to an electric variation by use of the fluid that has not been electrically charged.

According to an aspect of the invention, there is provided an ejection inspecting device, operable to inspect an ejection state of a fluid ejection device operable to eject a fluid, the ejection inspecting device comprising:

at least one pair of electrodes, disposed so that the fluid can pass;

an oscillation executing unit, connected to the electrodes, and operable to electrically oscillates;

an oscillation detecting unit, operable to detect an oscillation state oscillated by the oscillation executing unit by counting the number of oscillations during a predetermined period; and a control unit, operable to detect whether the fluid has been ejected from the fluid ejection device based on the number of oscillations detected during the predetermined period during which the fluid has not been ejected, and based on the number of oscillations detected during the predetermined period during which the fluid ejected therefrom has passed near the electrodes.

In the ejection inspecting device, the oscillation executing unit to which at least one pair of electrodes disposed so that a fluid can pass through the electrodes are connected is electrically oscillated, and the oscillation state is detected by counting the number of oscillations during a predetermined period. Accordingly, it is detected whether a fluid has been ejected from the fluid ejection device based on the number of oscillations during the predetermined period during which the fluid has not been ejected and based on the number of oscillations during the predetermined period during which the fluid ejected therefrom has passed near the electrodes. Thus, the presence or absence of the ejection of the fluid can be inspected by detecting the number of oscillations during the predetermined period, and the magnitude of a variation in the number of oscillations can be easily changed, for example, by appropriately setting a predetermined period. Therefore, when the ejection state of a fluid is inspected according to an electrical variation caused by the fluid that has not been electrified, the ejection state of the fluid can be inspected with greater ease and with higher accuracy. No specific limitations are imposed on the term "fluid" if the oscillation state of this fluid is varied when this is ejected to the neighborhood of the electrodes. Therefore, the "fluid" may be any one of a solid substance including powder, a liquid, and a gas. The distance defined by the term "near the electrodes" may be a distance that is empirically determined based on, for example, the shape of the electrodes, the arrangement of the electrodes, and the fluid amount.

The control unit may control the fluid ejection device so as to eject the fluid, and the control unit may detect that the fluid is ejected from the fluid ejection device if the number of oscillations obtained when the fluid ejected therefrom passes near the electrodes falls below a number based on the number of oscillations obtained when the fluid is not ejected.

In this case, it is possible to comparatively easily detect a difference in the oscillation state caused by the presence or absence of the ejection of the fluid by counting the number of oscillations during a predetermined period.

The electrodes may serve as capacitors, and the oscillation detecting unit may detect a variation in the oscillation state caused by a variation in electric capacity relative to the capacitors caused when the fluid passes near the electrodes.

The pair of electrodes may be disposed to face each other, and the oscillation executing unit may be disposed on a surface with which end parts of the electrodes facing each other are connected, the liquid being not allowed to pass through the end parts.

In this case, it is possible to connect the oscillation executing unit and the electrodes together by a shorter distance, and hence the oscillation state can be detected more easily. At this time, the oscillation detecting unit may also be disposed on the surface with which the end parts of the electrodes facing each other are connected together, the liquid being not allowed to pass through the end parts. The oscillation detecting unit may detect an oscillation state oscillated by the oscillation executing unit as a digital signal, and may output this signal to the control unit.

The oscillation executing unit may be a Colpitts oscillation circuit including a coil and a capacitor.

Preferably, the oscillation executing unit is formed of a Hartley type or Colpitts type positive feedback circuit. More preferably, a generally-used Colpitts oscillation circuit is employed.

The electrodes may be provided with a protective member that is provided at a side at which the fluid passes and that prevents the fluid from coming into contact with the electrodes.

In this case, it is possible to prevent the electrodes from being soiled, and hence the ejection state of the fluid can be inspected more reliably.

The pair of electrodes may be arranged side by side in such a manner as to form a plane. Even if the pair of electrodes are disposed in this manner not to face each other, it has been empirically confirmed that a variation occurs in the oscillation state if the fluid passes near the pair of electrodes. Therefore, this arrangement makes it easier to perform the ensuing maintenance than an arrangement formed so that a pair of electrodes face each other.

According to an aspect of the invention, there is also provided a printer, comprising:

the ejection inspecting device according to claim 1; an the fluid ejection device, operable to eject the fluid onto a target.

The printer frequently ejects a fluid onto a target, and the ejection state is highly required to be grasped, and hence the need to apply the present invention thereto is great.

According to an aspect of the invention, there is also provided a method of inspecting an ejection state of a fluid ejection device operable to eject a fluid, the method comprising:

detecting an oscillation state oscillated by an oscillation executing unit connected to at least one pair of electrodes by counting the number of oscillations during a predetermined period; and detecting whether the fluid has been ejected from the fluid ejection device based on the number of oscillations detected during the predetermined period during which the fluid has not been ejected, and based on the number of oscillations detected during the predetermined period during which the fluid ejected therefrom has passed near the electrodes.

In the ejection inspecting method, the oscillation executing unit to which at least one pair of electrodes disposed so that a fluid can pass through the electrodes are connected is electrically oscillated, and this oscillation state is detected by counting the number of oscillations during a predetermined period. Accordingly, it is detected whether a fluid has been ejected from the fluid ejection device based on the number of oscillations during the predetermined period during which the fluid has not been ejected and based on the number of oscillations during the predetermined period during which the fluid ejected there from has passed near the electrodes. Thus, the presence or absence of the ejection of the fluid can be inspected by detecting the number of oscillations during the predetermined period, and the magnitude of a variation in the number of oscillations can be easily changed, for example, by appropriately setting a predetermined period. Therefore, when the ejection state of a fluid is inspected according to an electrical variation caused by the fluid that has not been electrified, the ejection state of the fluid can be inspected with greater ease and with higher accuracy.

In this ejection inspecting method, the various aspects of the ejection inspecting device mentioned above may be employed, and a step of realizing each function of the ejection inspecting device mentioned above may be added.

Additionally, the present invention may be embodied in a program for allowing at least one computer to execute each step of the ejection inspecting method mentioned above.

The present disclosure relates to the subject matter contained in Japanese patent application No. 2007-213424 filed on Aug. 20, 2007 which is expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
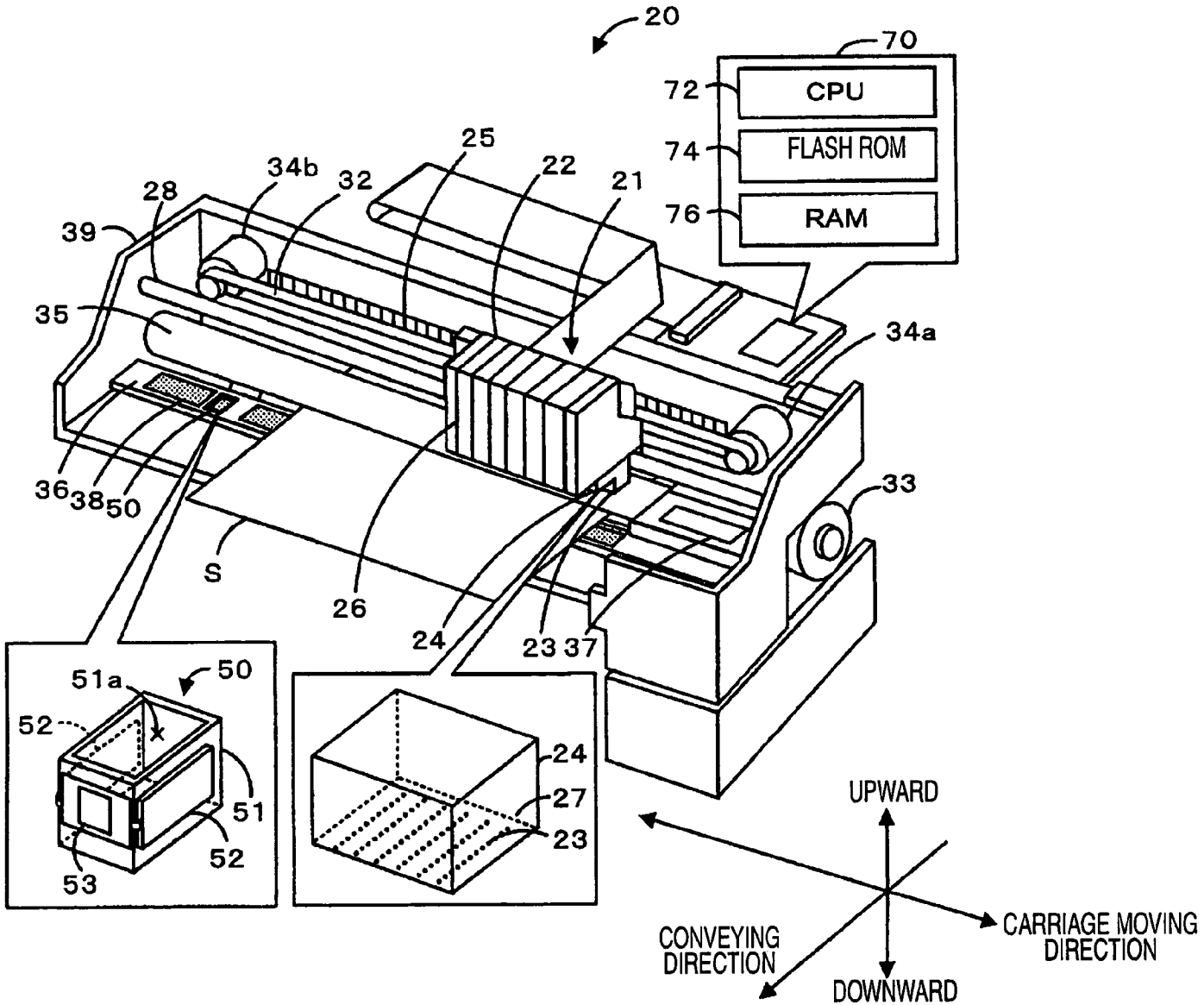
FIG. 1 is a schematic view of a structure of a printer that is an embodiment of the present invention.
Figure 2:
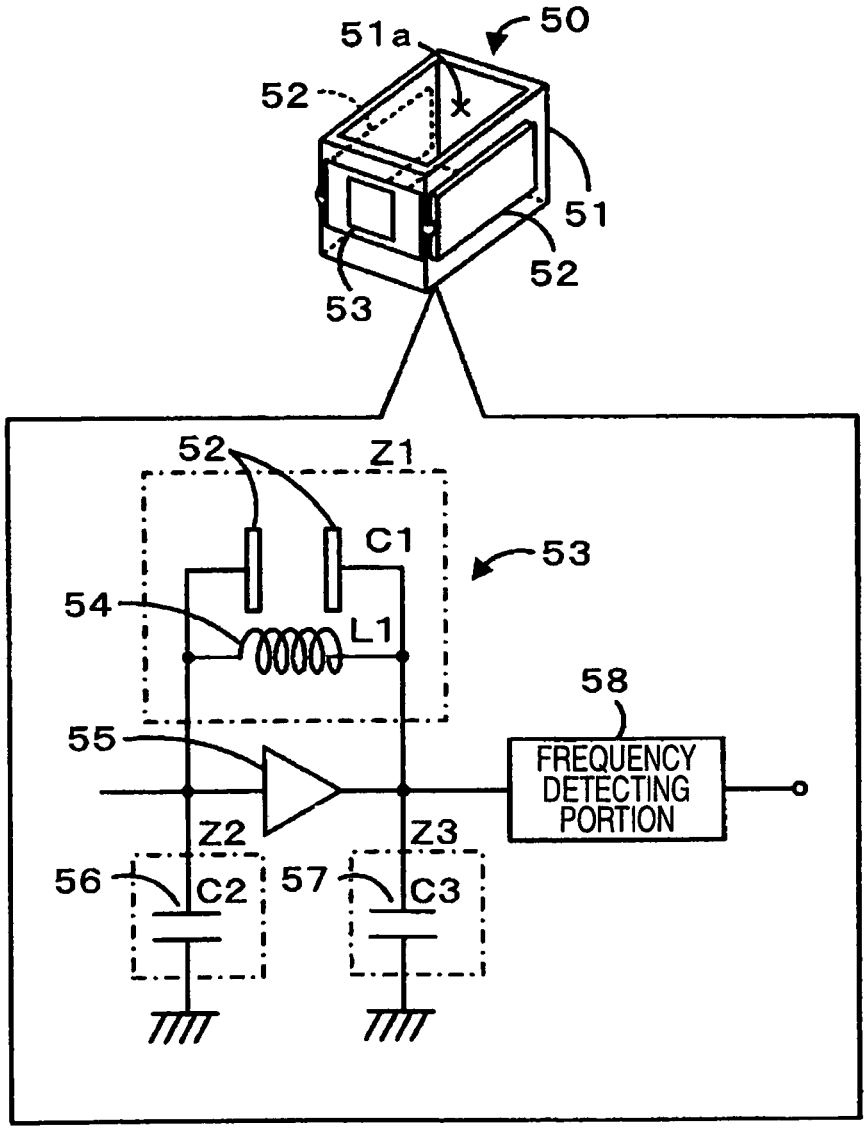
FIG. 2 is an explanatory drawing for explaining a nozzle inspecting device.

Next, an embodiment of the present invention will be described with reference to the attached drawings. FIG. 1 is a schematic view showing an example of the structure of a printer 20 of this embodiment, and FIG. 2 is an explanatory drawing for explaining a nozzle inspecting device 50. As shown in FIG. 1, the printer 20 of this embodiment includes an ink ejection device 21 that ejects ink, which is a fluid, onto a sheet of recording paper S, which serves as a target, a paper feed roller 35 that is driven by a drive motor 33 and that conveys sheets of recording paper S on a platen 36 from the back to the front in the figure, a capping device 37 disposed at the right end of the platen 36 in the figure, a flushing area 38 formed at the left end of the platen 36 in the figure, the nozzle inspecting device 50 that is disposed next to the flushing area 38 and that inspects an ejection state of ink ejected from the nozzle 23, and a controller 70 that controls the whole of the printer 20.

The ink ejection device 21 includes a carriage 22 that reciprocates rightwardly and leftwardly (i.e., in a carriage moving direction) along a carriage shaft 28 by a carriage belt 32, a print head 24 that ejects droplets of each color ink, which is a fluid, from the nozzle 23 while applying pressure to the ink, and an ink cartridge 26 that contains each color ink and that supplies the contained ink to the print head 24. A carriage belt 32 extended between a carriage motor 34*a* attached to the right side of a frame 39 and a driven roller 34*b* attached to the left side of the frame 39 is driven by the carriage motor 34*a*. The carriage 22 is moved in response to the movement of the carriage belt 32 driven by the carriage motor 34*a*. A linear encoder 25 that detects the position of the carriage 22 is disposed on the back of the carriage 22. The position of the carriage 22 can be managed by using the linear encoder 25. The print head 24 is disposed at the lower part of the carriage 22. According to a method in which pressure is applied onto ink while applying a voltage to a piezoelectric element and deforming this piezoelectric element, each color ink is ejected from nozzles 23 disposed on the underface of the print head 24. Nozzle rows 27 in which the nozzles 23 are arranged and each of which corresponds to each color are disposed on the underface of the print head 24. The print head 24 may employ a method in which pressure is applied onto ink by bubbles generated by applying a voltage to a heating resistance device (e.g., a heater) and then heating the ink. Ink cartridges 26 are mounted in the carriage 22, and each of the ink cartridges 26 contains each color ink of cyan (C), magenta (M), yellow (Y), red (R), blue (B), and black (K).

The capping device 37 is used for a cleaning process in which ink remaining in the nozzle 23 is forcibly sucked out by applying negative pressure to the inside of the apparatus by use of a suction pump (not shown) when the print head 24 comes into contact therewith. In addition to this, the capping device 37 is used to seal the nozzle 23 so as to prevent the nozzle 23 from being dried while printing is being stopped. The flushing area 38 is an area used to perform a so-called flushing process in which ink droplets are forcibly ejected, irrespective of printing data, at regular intervals or at a predetermined timing so as to prevent ink from being dried and hardened at the forward end of the nozzle 23.

As shown in FIG. 1 and FIG. 2, the nozzle inspecting device 50 includes a protective member 51 through which ink droplets ejected from the nozzle 23 of the print head 24 can pass, a pair of electrodes 52 fixed to side faces, respectively, of the protective member 51 such that the electrodes 52 face each other, and an oscillation circuit 53 that is connected to the pair of electrodes 52 and that oscillates at a predetermined oscillation frequency. The protective member 51 is made of a water-repellent member to prevent ink droplets from coming into contact with the electrode 52, and is formed as a frame structure having a rectangular passage opening 51*a*. In the protective member 51, its thickness, the size of the passage opening 51*a*, etc., are empirically designed to have such a distance between the electrodes 52 as to obtain a desired output value in a nozzle inspecting process described later. The passage opening 51*a* is formed to be longer and wider than the nozzle row 27 of the print head 24. Ink droplets that have passed through the protective member 51 are absorbed by an ink absorber fixed without contact with the protective member 51. Each of the pair of electrodes 52 serves as a capacitor formed in a rectangular plate shape, and is a longer rectangle than the nozzle row 27 on the assumption that the direction of the nozzle row 27 is a longitudinal direction.

As shown in FIG. 2, the oscillation circuit 53 serves as a Colpitts oscillation circuit of a positive feedback circuit connected to the electrodes 52 each of which serves as a capacitor. The oscillation circuit 53 includes a coil 54 connected in parallel to the electrodes 52 connected in series to a power source, a buffer 55 connected in parallel to the coil 54, a capacitor 56 connected to an end of the coil 54 and to the ground, and a capacitor 57 connected to the other end of the coil 54 and to the ground. From the relationship with an oscillation frequency f to be detected, the oscillation circuit 53 is disposed on a surface through which ink droplets cannot pass and with which the side faces of the protective member 51 to each of which the electrode 52 is fixed are connected to each other so that an electric wire is shortened as much as possible. A frequency detecting portion 58 that detects the oscillation frequency of the oscillation circuit 53 is connected near the oscillation circuit 53. In the oscillation circuit 53, the oscillation condition is expressed as in Equation (1) where Z1 is the electrodes 52 and the coil 54, Z2 is the capacitor 56, and Z3 is the capacitor 57. Therefore, the electrodes 52 and the coil 54 are designed to be an L component that satisfies Equation (1), not to be in a resonant state. From Equation (1) and a phase condition, Equation (2) can be drawn where C1 is the electric capacity of the electrodes 52, L1 is the inductance of the coil 54, C2 is the electric capacity of the capacitor 56, and C3 is the electric capacity of the capacitor 57. If this is solved for X by using the phase condition, the oscillation frequency f can be expressed by Equation (3). The electrodes 52, the capacitors 56 and 57, and the coil 54 are empirically set to have values C1 to C3 and L1, respectively, at which the oscillation frequency f is adequately changed when ink droplets pass between the electrodes 52 during a gate time tg described later in detail. The elements may be designed in the following way. For example, the area of the electrode 52 is 4 $cm^2$, the distance between the electrodes 52 is 3 cm, L1 is 2 μH, C2 of the capacitor 56 is 10 pF, and C3 of the capacitor 57 is 10 pF. Preferably, the oscillation frequency f is set to have a higher frequency (e.g., several tens of megahertzs (MHz) to several hundred megahertzs (MHz)), from the viewpoint that a nozzle inspection is made with high accuracy.

$$Z1+Z2+Z3=0 \quad \text{[Formula I]}$$

$$\frac{\omega \cdot L1}{1-\omega^2 L1 C1} + \frac{1}{\omega \cdot C2} + \frac{1}{\omega \cdot C3} = 0 \quad \text{[Formula 2]}$$

$$f = \frac{1}{2\pi}\sqrt{\frac{C2+C3}{L1(C1 \cdot C2 + C2 \cdot C3 + C3 \cdot C1)}} \quad \text{[Formula 3]}$$

As shown in FIG. 1, the controller 70 serves as a microprocessor including a CPU 72 used as a principal element, and additionally includes a flash ROM 74 that stores various processing programs and that erasably writes data, a RAM 76 that temporarily saves data or stores data, and an input/output port not shown. Processing programs of, for example, a nozzle inspecting routine described later, a cleaning processing routine, and a printing processing routine are stored in the flash ROM 74. The RAM 76 has a printing buffering area in which print data is stored. A voltage signal output from the frequency detecting portion 58 of the nozzle inspecting device 50, a position signal of the carriage 22 from the linear encoder 25, etc., are input to the controller 70 through an input port not shown. Additionally, for example, a print job output from a client (e.g., a personal computer) not shown is also input to the controller 70. On the other hand, a control signal to the print head 24, a control signal to the drive motor 33, a drive signal to the carriage motor 34*a*, a control signal to the nozzle inspecting device 50, etc., are output from the controller 70 through an output port not shown.

Figure 3:
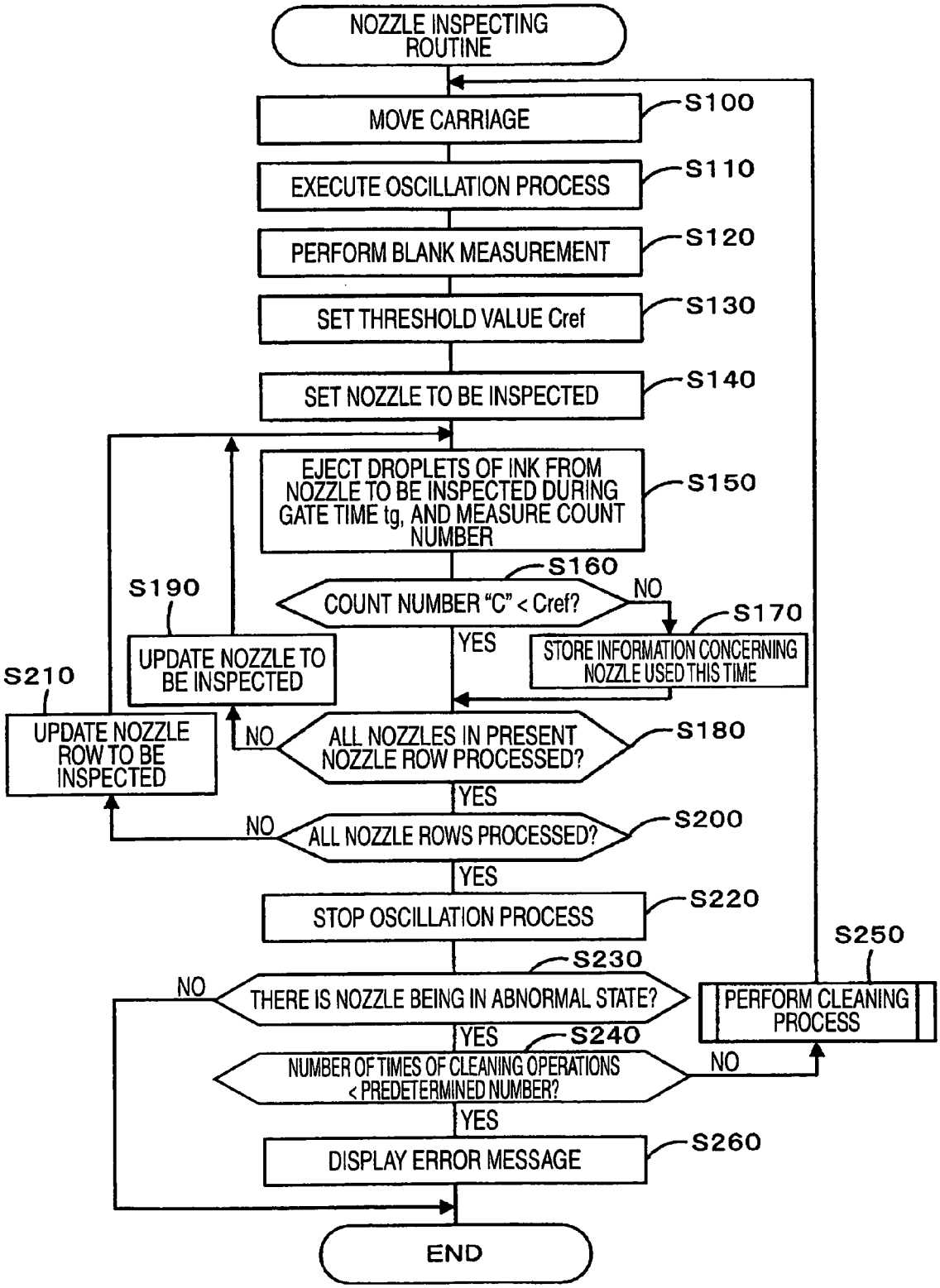
FIG. 3 shows an example of a flow chart of a nozzle inspecting routine.

Next, a description will be given of the operation of the thus structured ink-jet printer 20 of this embodiment, especially a nozzle inspecting process for inspecting whether ink droplets can be normally ejected from the nozzle 23. FIG. 3 is an example of a flow chart showing the nozzle inspecting routine executed by the CPU 72 of the controller 70. This routine is executed by the CPU 72 when a predetermined nozzle inspecting timing is reached. For example, the predetermined nozzle inspecting timing is immediately before a printing process for printing print data on a sheet of recording paper S or is after the elapse of a predetermined period from the turn-on of a power source. When this routine is started, the CPU 72 first moves the carriage 22 by driving the carriage motor 34*a* so that the nozzle row 27 of the carriage 22 is located above the passage opening 51*a* of the nozzle inspecting device 50 (step S100), and then the power source (not shown) of the nozzle inspecting device 50 is turned on, and an oscillation process by the oscillation circuit 53 is executed (step S110). Accordingly, the electrodes 52, as well as the oscillation circuit 53, oscillate at a predetermined oscillation frequency f fixed by various structures of the oscillation circuit 53 according to Equation (3). Thereafter, the CPU 72 executes blank measurement (step S120), and sets a threshold value Cref used to inspect the nozzle based on results obtained by the blank measurement (step S130). Herein, the blank measurement is performed such that the number of peaks is counted by the frequency detecting portion 58 during the elapse of a predetermined gate time tg, and this value is fixed as the count value "A" of the blank measurement. The threshold value Cref is fixed as a value based on the count value "A", and is set to have a value of a predetermined percentage (e.g., 90%, 80%, or 70%) of the count value "A" according to which it can be determined that ink droplets are being ejected from the print head 24. Preferably, the threshold value Cref is fixed as the value of a predetermined percentage rather than as the count value "A", because false detection can be prevented.

Thereafter, the CPU 72 sets a nozzle to be inspected (step S140), and allows ink to be ejected from the nozzle 23 to be inspected during a gate time tg, and allows the frequency detecting portion 58 to count the number of peaks during the gate time (step S150). The setting of the nozzle to be inspected is fixed as being performed in order from the first nozzle 23 of the nozzle row 27 located at the end. The gate time tg is empirically fixed as a time during which a variation in the oscillation frequency resulting from the presence or absence of an ejection of ink droplets and the ejected number of ink droplets per unit time can be adequately detected. Herein, when ink droplets are ejected from the nozzle 23 to be inspected, the ink droplets are fixed as being ejected with the maximum number per unit time that the print head 24 can perform. Thereafter, the CPU 72 determines whether the count number C counted by the frequency detecting portion 58 during the gate time tg falls below the threshold value Cref (step S160). If the count number C does not fall below the threshold value Cref, the nozzle 23 inspected this time is regarded as being in an abnormal state, such as a clogging state, and information that specifies this nozzle 23 (e.g., information showing where this nozzle is in the order in a nozzle row) is stored in a predetermined area of the RAM 74 (step S170).

Figure 4:
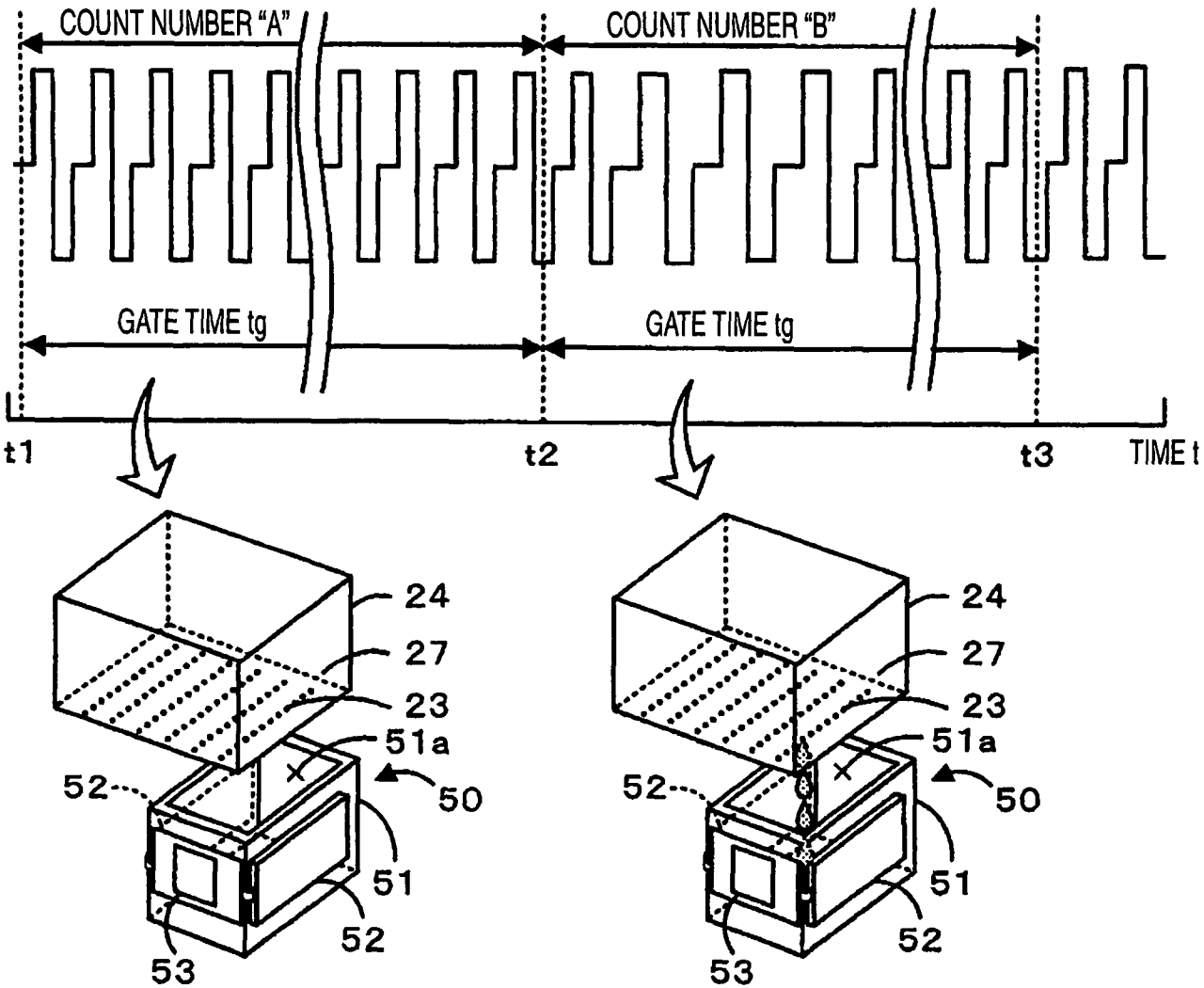
FIG. 4 is an explanatory drawing for explaining a determination of whether an ejection from a nozzle is in an abnormal state.

Referring to FIG. 4, a description will be given of a determination of whether the ejection from the nozzle 23 is abnormal. FIG. 4 is an explanatory drawing for explaining a determination of whether the ejection from the nozzle 23 is abnormal. As described above, when the oscillation circuit 53 oscillates, a sine waveform is detected in the frequency detecting portion 58. In the blank measurement, the state of not ejecting ink droplets from the print head 24 is reached, and hence the oscillation circuit 53 oscillates with substantially constant cycles. On the other hand, when ink droplets are ejected to the passage opening 51*a*, the permittivity between the electrodes 52 is increased by the ink droplets, and hence the electric capacity is increased, and the frequency is decreased. As a result, the oscillations are made with long cycles with respect to the blank measurement, and a count number "B" smaller than the count number A detected by the blank measurement is detected by the frequency detecting portion 58 during the same gate time tg. Therefore, when ink droplets are normally ejected from the nozzle 23, a count number that is sufficiently small with respect to the threshold value Cref is detected by the frequency detecting portion 58. On the other hand, when ink droplets are not normally ejected therefrom, a count number nearer to the count number "A" of the blank measurement is detected by the frequency detecting portion 58. Whether ink droplets are being ejected from the nozzle 23 is detected in this way. The blank measurement is performed when a nozzle inspection is made, and, with respect to results obtained by this blank measurement, it is inspected whether ink droplets are being ejected from the nozzle 23, and hence the nozzle inspection can be made without corrections to a time-dependent change or to the influence of temperature.

After step S170 or when the count number "C" falls below the threshold value Cref in step S160 (i.e., when the nozzle 23 is in a normal state this time), the CPU 72 determines whether all nozzles 23 included in the nozzle row 27 being inspected at the present time have been inspected (step S180). If there is a nozzle 23 that has not yet been inspected in the nozzle row 27 being inspected at the present time, the nozzle 23 to be inspected is updated to a not-yet-inspected nozzle (step S190), and step S150 and steps following this step are executed again. On the other hand, if all nozzles 23 included in the nozzle row 27 being inspected at the present time have been inspected in step S180, it is determined whether all nozzle rows 27 included in the print head 24 have been inspected (step S200). If there is a nozzle row 27 that has not yet been inspected, the nozzle row 27 to be inspected is updated to a not-yet-inspected nozzle row 27 (step S210), and step S150 and steps following this step are executed again.

On the other hand, if all nozzle rows 27 included in the print head 24 have been inspected in step S200, the power source of the oscillation circuit 53 is turned off, and the oscillation process is stopped (step S220).

Thereafter, based on memory contents in a predetermined area of the RAM 76, the CPU 72 determines whether there is a nozzle 23 being in an abnormal state among all nozzles 23 arranged on the print head 24 (step S230). If there is a nozzle 23 being in an abnormal state, it is determined whether the number of cleaning operations performed to remove the abnormal state has reached a predetermined upper limit number (e.g., three times) before cleaning the print head 24 (step S240) although the print head 24 is cleaned in consideration of being caused by clogging. If the number of cleaning operations is less than the upper limit number, the CPU 72 executes the cleaning process of the print head 24 (step S250). In more detail, the inside of the capping device 37 is brought into a negative pressure state by driving a suction pump not shown, and ink with which the nozzle 23 is clogged is suctioned and discharged from the nozzle 23. The execution of this cleaning process makes it possible to remove ink remaining in the nozzle 23 (e.g., ink whose viscosity has become high resulting from being left therein for a long time). To examine whether the abnormal state of the nozzle 23 has been removed after performing the cleaning process in step S250, step S100 and steps following this step are executed again. In step S100 and steps following this step after completing the cleaning process, only the nozzle 23 being in an abnormal state may be inspected again, or all nozzles 23 may be inspected again.

On the other hand, if the number of times by which cleaning is performed has reached the upper limit number in step S240, the nozzle 23 being in an abnormal state is regarded as not being normalized even if this nozzle 23 is cleaned, and an error message is displayed on an operation panel not shown (step S260), thus ending this routine. On the other hand, if there is no nozzle 23 being in an abnormal state in step S230, this routine is ended as it is. Accordingly, for example, a printing process is performed by the print head 24 having no nozzle clogged with ink, which has undergone a nozzle inspection. In the printing process, the CPU 72 develops print data stored in a print buffer of the RAM 76 into a bitmap image, and, based on developed data, drives the print head 24 so as to eject each color ink contained in the ink cartridge 26 onto a sheet of recording paper S, and conveys the sheet of recording paper S while driving the paper feed roller 35 by the drive motor 33.

According to the printer 20 of this embodiment as described above, the oscillation circuit 53, which is connected to the pair of electrodes 52 facing each other that are disposed so that ink droplets can pass therebetween, electrically oscillates. The frequency detecting portion 58 detects this oscillation state. It is detected whether ink droplets have been normally ejected from the ink ejection device 21, according to whether the count number "C" that is the number of peaks counted during a gate time tg during which ink droplets are ejected falls below the threshold value Cref that is a predetermined percentage of the count number "A" that is the number of peaks counted during a gate time tg during which ink droplets are not ejected. At this time, if a plurality of droplets of ink are successively ejected during the gate time tg, a variation in frequency for each droplet of ink can be accumulated although a variation in the electric capacity for a single droplet of ink is generally small. Therefore, this can be easily seen as a change in the count number "C" by adjusting the gate time tg even if a droplet of ink is small in permittivity. Thus, the presence or absence of the ejection of ink droplets is inspected by detecting a variation in oscillation frequency caused by a variation in permittivity caused by whether ink droplets have passed between the electrodes 52. Therefore, when the ejection state of ink is inspected without electrifying ink droplets, a difference in the oscillation state caused by the presence or absence of the ejection of ink droplets can be detected with greater ease and with higher accuracy by counting the number of oscillations during the gate time tg. Additionally, the oscillation circuit 53 and the frequency detecting portion 58 are disposed on the surface with which end parts of the pair of electrodes 52 through which ink droplets do not pass are connected together, and the oscillation circuit 53 and the electrodes 52 can be connected together by a shorter distance, and hence the oscillation state can be detected more easily. Still additionally, the oscillation circuit 53 is a generally-used Colpitts oscillation circuit including a coil and capacitors, which is advantageously desirable. Still additionally, since the protective member 51 is provided to prevent ink droplets from coming into contact with the electrodes 52, the electrodes 52 can be prevented from being made dirty, and the ejection state of ink droplets can be inspected more reliably. Still additionally, the printer frequently ejects ink droplets onto a sheet of recording paper S, and the ejection state is highly required to be grasped, and hence the need to apply the present invention is great. Still additionally, whether ink droplets are being ejected is inspected by detecting a difference with the blank measurement, and hence there is no need to perform complex corrections, and the ejection state of ink can be inspected by a comparatively easy process. Still additionally, a variation in the electric capacity of the electrodes 52 is converted into the oscillation frequency by the oscillation circuit 53, and is detected by the frequency detecting portion 58, and hence all can be digitally processed. Therefore, the ejection state of ink can be inspected without using an A/D converter or the like.

The present invention is not limited to the above-mentioned embodiment in any way, and can, of course, be embodied in various forms as long as these fall within the technical range of the present invention.

For example, although the protective member 51 is provided with the electrodes 52 in the above-mentioned embodiment, the electrodes 52 may be merely disposed to face each other without using the protective member 51. This structure also makes it possible to inspect the ejection state of ink without electrifying ink droplets. In particular, since blank measurement is first performed, and then a nozzle inspection is made while ejecting ink droplets, the nozzle inspection can be made even if foreign substances adhere to the electrodes 52.

In the above-mentioned embodiment, the ejection state of ink is inspected by using the count number "C" counted during a predetermined gate time tg, i.e., by using the oscillation frequency. However, a detecting operation may be performed both in a case in which ink droplets are not ejected during a lapse until a predetermined wavenumber is counted (i.e., blank measurement) and in a case in which ink droplets are ejected there during. Accordingly, whether ink droplets have been normally ejected may be detected by whether the elapsed time shown in a result obtained by ejecting ink droplets is longer than the elapsed time shown in a result obtained by the blank measurement. This operation also makes it possible to inspect the ejection state of ink without electrifying ink droplets.

In the above-mentioned embodiment, the oscillation circuit 53 is a Colpitts oscillation circuit in which the capacitors 56 and 57 and the coil 54 are connected together. However, the oscillation circuit 53 may be a Hartley oscillation circuit in which one capacitor and two coils are connected together. This structure also makes it possible to inspect the ejection state of ink without electrifying ink droplets because it is possible to detect a variation in the oscillation frequency caused by a variation in the electric capacity of the electrodes 52 and 52 resulting from the presence or absence of the ejection of ink droplets. Additionally, although the oscillation circuit 53 includes the buffer 55, this buffer may be removed.

In the above-mentioned embodiment, the electrodes 52 between which ink droplets pass are connected in parallel to the coil 54 in the oscillation circuit 53 (see FIG. 2). However, for example, in FIG. 2, the electrodes 52 between which ink droplets pass and the capacitor 56 may be replaced with each other, or the electrodes 52 between which ink droplets pass and the capacitor 57 may be replaced with each other. This structure also makes it possible to detect a variation in the oscillation frequency caused by the passage of ink droplets.

Figure 5A:
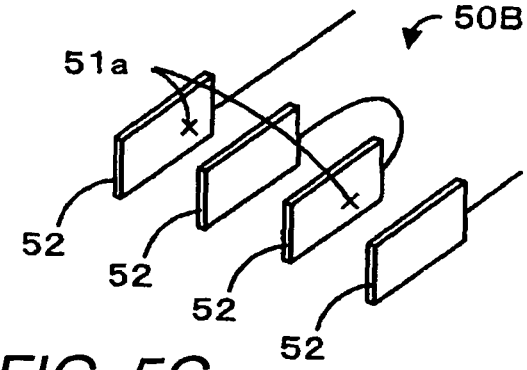
FIG. 5A to FIG. 5F are explanatory drawings for explaining other nozzle inspecting devices.
Figure 5B:
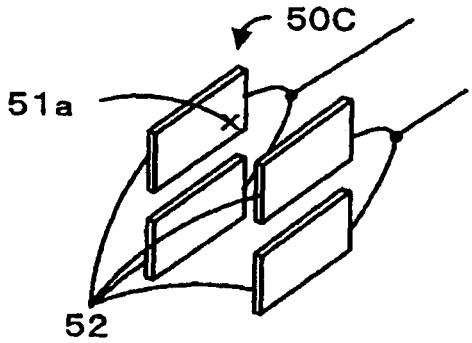
Figure 5C:
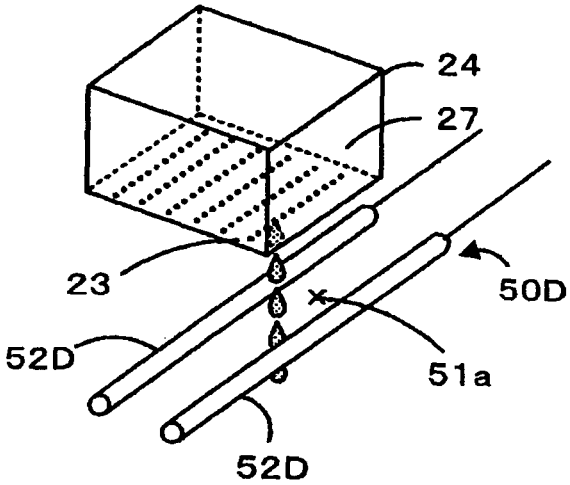
Figure 5D:
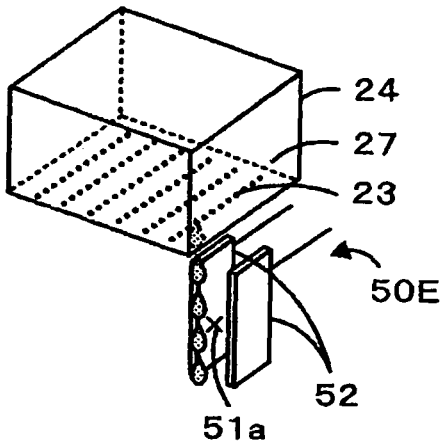
Figure 5E:
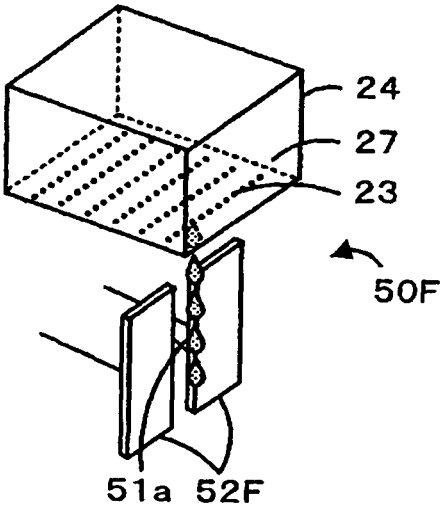
Figure 5F:
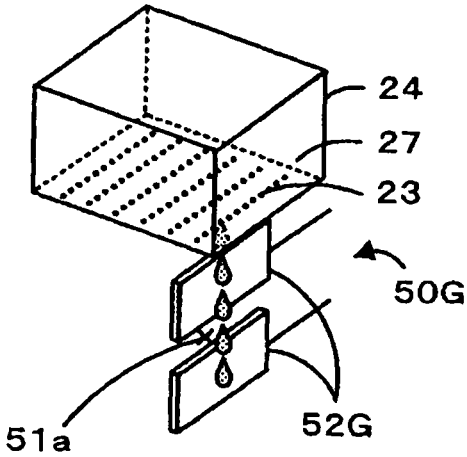

In the above-mentioned embodiment, the electrodes 52 are provided as a single pair. However, these may be provided as a plurality of pairs of electrodes 52 as shown in FIG. 5A and FIG. 5B. FIG. 5A to FIG. 5F are explanatory drawings of other nozzle inspecting devices 50. FIG. 5A is an explanatory drawing of a nozzle inspecting device SOB, FIG. 5B is an explanatory drawing of a nozzle inspecting device 50C, FIG. 5C is an explanatory drawing of a nozzle inspecting device SOD, FIG. 5D is an explanatory drawing of a nozzle inspecting device 50E, FIG. 5E is an explanatory drawing of a nozzle inspecting device 50F, and FIG. 5F is an explanatory drawing of a nozzle inspecting device 50G. As shown in FIG. 5A to FIG. 5F, the nozzle inspecting device 50B may be employed in which pairs of horizontally-long electrodes 52 are arranged in the lateral direction in a standing state (FIG. 5A), and the nozzle inspecting device 50C may be employed in which a plurality of electrodes 52 arranged at upper and lower sides are connected together so as to face each other (FIG. 5B). Additionally, the nozzle inspecting device 50E may be employed in which the electrode 52 is shaped in a vertically-long rectangle not in a horizontally-long rectangle (FIG. 5D), and the nozzle inspecting device 50D may be employed in which the electrodes 52D are each shaped, for example, in a sphere or in a bar as shown in FIG. 5C not in a rectangle. Besides, the electrode 52 may be shaped in any form.

In the above-mentioned embodiment, ink droplets pass between the electrodes 52 facing each other. However, ink droplets may pass near the electrodes 52 facing each other (FIG. 5D). It has been confirmed by experiments that this structure also brings about the variation of the oscillation state in the nozzle inspecting device 50. This variation of the oscillation state is caused by allowing ink droplets to cross an electric field generated by the pair of electrodes 52. The distance defined by the term "near the electrodes 52" may be set so that a variation in the oscillation frequency can be fully confirmed based on, for example, the shape or the disposed position of the electrodes 52 or based on the amount of ink droplets ejected therefrom. In the above-mentioned embodiment, the electrodes 52 are arranged to face each other. However, the electrodes 52 may be arranged not to face each other. For example, as shown in FIG. 5E, the nozzle inspecting device 50F may be employed in which vertically-long electrodes 52F forming a plane along the nozzle row 27 are arranged to be next to each other. Additionally, as shown in FIG. 5F, the nozzle inspecting device 50G may be employed in which horizontally-long electrodes 52G forming a plane along the nozzle row 27 are arranged at upper and lower sides, respectively. This structure also makes it possible to inspect the ejection state of ink droplets with greater ease and with higher accuracy. Additionally, this structure makes the ensuing maintenance, such as dust-off of electrode surfaces, easier, and makes the positioning during assemblage easier than a structure having the electrodes 52 facing each other, and, furthermore, makes it possible to achieve compaction in a direction from the electrode surface to the ejection position of ink droplets. At this time, if the positions of the capacitors 56 and 57 are replaced with those of the electrodes 52 in FIG. 2, the following nozzle inspecting device may be formed. In detail, for example, only one of the bar-like electrodes (see FIG. 5C) is connected to the power source side in the oscillation circuit 53, and the frame 39 connected to the ground is used as the other electrode, so that ink droplets are allowed to pass near the bar-like electrode and the frame 39. This structure makes it possible to achieve structural simplification because the frame 39 is used as described above. The pair of electrodes 52 may be arranged in any direction if it is a direction in which ink droplets ejected from the print head 24 do not come into contact therewith.

In the above-mentioned embodiment, the single oscillation circuit 53 is provided for the single pair of electrodes 52. However, a plurality of oscillation circuits 53 may be provided for the pair of electrodes 52. For example, the following structure may be formed. In detail, in a nozzle row 27 having a longer length, an electrode 52 is divided into a plurality of electrode areas in the longitudinal direction of the nozzle row 27, and the oscillation circuit 53 is provided in each area. According to an area in which a nozzle 23 to be inspected is disposed, switching is performed among the plurality of oscillation circuits 53 so as to make a nozzle inspection. This structure makes it possible to further heighten the accuracy of the nozzle inspection because a measurement error of the oscillation frequency caused by where the nozzle 23 to be inspected is located in the order in the nozzle row 27 can be reduced.

In the above-mentioned embodiment, the nozzle inspecting device 50 is disposed next to the flushing area 38. However, the nozzle inspecting device 50 may be disposed within the flushing area 38. Alternatively, the nozzle inspecting device 50 may be disposed within the capping device 37. In the above-mentioned embodiment, only the pair of electrodes 52 are used. However, for example, the pair of electrodes 52 may be provided for each nozzle row 27 having each individual color.

In the above-mentioned embodiment, the oscillation circuit 53 is disposed on the surface with which the side faces of the protective member 51 to each of which each of the electrodes 52 is fixed are connected together and through which ink droplets do not pass. However, the oscillation circuit 53 may be disposed at a place other than this face.

In the above-mentioned embodiment, blank measurement is performed whenever a nozzle inspection is made. However, blank measurement may be performed after a certain period (e.g., the printing end of several print jobs, one week, or one month) elapses, so that the threshold value Cref is reset. This operation makes it possible to make a nozzle inspection more efficiently because process steps for the blank measurement can be removed to some degree.

In the above-mentioned embodiment, one threshold value Cref that determines the count number "C" counted by the frequency detecting portion 58 is set, and it is inspected whether ink droplets are being ejected. However, two or more threshold values that determine the count number "C" counted by the frequency detecting portion 58 may be set, and an inspection of a quantitative comparison of the ejection quantity of ink droplets, as well as an inspection of whether ink droplets are being ejected, may be made. This makes it possible to make a nozzle inspection in more detail.

In the above-mentioned embodiment, the ink ejection device 21 is structured to include the carriage 22 moving in a carriage moving direction. However, the ink ejection device may be structured to include a so-called line inkjet head having nozzle rows 27 each of which has each individual color in the width direction of a sheet of recording paper S, and a pair of electrodes may be disposed in the direction of the nozzle row so as to make a nozzle inspection. This structure also makes it possible to inspect the ejection state of ink without electrifying ink droplets.

In the above-mentioned embodiment, as an example, the fluid ejection device of the present invention is embodied in the printer 20. However, the fluid ejection device of the present invention may be embodied in a fluid ejection device that ejects liquids other than ink, a liquefied substance (dispersion liquid) in which particles of functional materials have been dispersed, or a gel-like fluid, or may be embodied in a fluid ejection device that ejects a solid substance that can be ejected in the form of a fluid. Examples of such apparatuses include a liquid ejection device that ejects a liquid in which electrode materials or color materials, which are used to produce a liquid crystal display, an EL (electro-luminescence) display, a surface emitting display, and a color filter, are dissolved; a liquefied-substance ejection device that ejects a liquefied substance in which those materials are dissolved; and a liquid ejection device that is used as a precision pipet and that ejects a liquid serving as a sample. Additionally, examples include a liquid ejection device that ejects a lubricant to a precision machine, such as a clock or a camera, with pinpoint accuracy; a liquid ejection device that ejects a liquid of transparent resin, such as ultraviolet curable resin, onto a substrate in order to form a hemispherical micro-lens (optical lens), or the like, that is used as, for example, an optical communication element; a liquid ejection device that ejects an acid or alkaline etchant to etch a substrate or the like; a fluid ejection device that ejects a gel; and a powder-jet type recording apparatus that ejects fine particles such as toner.

In the above-mentioned embodiment, the printer 20 is structured as a printer including the ink ejection device 21. However, the printer 20 may be structured as a multifunction printer provided with a scanner or as a fax machine. Although the invention has been described in the aspect of the printer 20, it may be described in the aspect of an ejection inspecting method or in the aspect of a program for this method.

What is claimed is:

1. An ejection inspecting device, operable to inspect an ejection state of a fluid ejection device operable to eject a fluid, the ejection inspecting device comprising:

at least one pair of electrodes, disposed so that the fluid can pass;

a Colpitts oscillation circuit, connected to the electrodes, and operable to electrically oscillate;

a counter, operable to count a counted number of peaks of oscillations oscillated by the Colpitts oscillation circuit during a predetermined period;

an oscillation detecting unit, operable to detect an oscillation state from the counted number of oscillations; and a control unit, operable to detect whether the fluid has been ejected from the fluid ejection device based on a first number of oscillations, counted during the predetermined period, during which the fluid has not been ejected, and a second number of oscillations, counted during the predetermined period, during which the fluid has been ejected and has passed near the electrodes, wherein the Colpitts oscillation circuit includes a coil connected in parallel to the electrodes, and a capacitor connected to an end of the coil, and the electrodes and the coil are set not to be in a resonant state.

2. The ejection inspecting device according to claim 1, wherein the control unit controls the fluid ejection device so as to eject the fluid, and the control unit detects that the fluid is ejected from the fluid ejection device if the number of oscillations obtained when the fluid ejected and passed near the electrodes falls below a number based on the number of oscillations obtained when the fluid has not been ejected.

3. The ejection inspecting device according to claim 1, wherein the electrodes serve as capacitors, and the oscillation detecting unit detects a variation in the oscillation state caused by a variation in electric capacity relative to the capacitors caused when the fluid passes near the electrodes.

4. The ejection inspecting device according to claim 1, wherein the pair of electrodes are disposed to face each other, and the Colpitts oscillation circuit is disposed on a surface to which end parts of the electrodes facing each other are connected, the liquid being not allowed to pass through the end parts.

5. The ejection inspecting device according to claim 1, wherein the electrodes are provided with a protective member that is provided at a side at which the fluid passes and that prevents the fluid from coming into contact with the electrodes.

6. A printer, comprising:

the ejection inspecting device according to claim 1; and the fluid ejection device, operable to eject the fluid onto a target.

7. An ejection inspecting device operable to inspect an ejection state of a fluid ejection device operable to eject a fluid, the ejection inspecting device comprising;

at least one pair of electrodes disposed so that the fluid can pass;

a Colpitts oscillation circuit, connected to the electrodes, and operable to electrically oscillate;

a frequency detecting counter, operable to detect a frequency count and a counted number of peaks of oscillations oscillated by the Colpitts oscillation circuit during a predetermined period;

an oscillation detecting unit, operable to detect an oscillation state from the counted number frequency of oscillations; and a control unit, operable to detect whether the fluid has been elected from the fluid ejection device based on a first number frequency of oscillations, counted during the predetermined period, and detected in a state where the fluid has not been ejected, and a second number frequency of oscillations counted during the predetermined period, and detected in a state where the fluid has been ejected and has passed near the electrodes, wherein the Colpitts oscillation circuit includes a coil connected in parallel to the electrodes, and a capacitor connected to an end of the coil, and the electrodes and the coil are set not to be in a resonant state.

8. The ejection inspecting device according to claim 7, wherein the control unit controls the fluid ejection device so as to eject the fluid, and the control unit detects determines that the fluid is ejected from the fluid ejection device, if the second number frequency of oscillations obtained when the fluid ejected and passed near the electrodes falls below a number based on the number the first frequency of oscillations obtained when the fluid has not been ejected.

9. The ejection inspecting device according to claim 7, wherein the electrodes serve as capacitors, and the oscillation detecting unit detects a variation in the oscillation state caused by a variation in electric capacity relative to the c apacitors caused when the fluid passes near the electrodes.

10. The ejection inspecting device according to claim 7, wherein the pair of electrodes are disposed to face each other, and the Colpitts oscillation circuit is disposed on a surface to which end parts of the electrodes facing each other are connected, the liquid being not allowed to pass through the end parts.

11. The ejection inspecting device according to claim 7, wherein the electrodes are provided with a protective member that is provided at a side at which the fluid passes and that prevents the fluid from coming into contact with the electrodes.

12. A printer, comprising:

the ejection inspecting device according to claim 7; and the fluid ejection device, wherein the fluid ejection device is operable to eject the fluid onto a target.

* * * * *